US007768199B2

(12) United States Patent
Tessier

(10) Patent No.: US 7,768,199 B2
(45) Date of Patent: Aug. 3, 2010

(54) PLASMA DISPLAY-PANEL COMPRISING A REDUCED-SECTION DISCHARGE EXPANSION ZONE

(75) Inventor: Laurent Tessier, Fontaine (FR)

(73) Assignee: Thomson Licensing, Boulogne Billancourt (FR)

( * ) Notice: Subject to any disclaimer, the term of this patent is extended or adjusted under 35 U.S.C. 154(b) by 823 days.

(21) Appl. No.: 10/558,037

(22) PCT Filed: May 26, 2004

(86) PCT No.: PCT/FR2004/050207

§ 371 (c)(1),
(2), (4) Date: Feb. 9, 2007

(87) PCT Pub. No.: WO2004/107385

PCT Pub. Date: Dec. 9, 2004

(65) Prior Publication Data

US 2007/0241996 A1 Oct. 18, 2007

(30) Foreign Application Priority Data

May 26, 2003 (FR) ..... 03 06305

(51) Int. Cl.
*H01J 17/49* (2006.01)

(52) U.S. Cl. ..... 313/582; 313/611

(58) Field of Classification Search ..... 313/582, 313/611

See application file for complete search history.

(56) References Cited

U.S. PATENT DOCUMENTS 5,825,128 A * 10/1998 Betsui et al. ..... 313/582
6,476,554 B1 * 11/2002 Snijkers et al. ..... 313/586
6,960,881 B2 * 11/2005 Park et al. ..... 313/582
7,567,034 B2 * 7/2009 Su et al. ..... 313/582
7,597,604 B2 * 10/2009 Kao et al. ..... 445/24
2001/0040539 A1 * 11/2001 Hashimoto ..... 345/60
2003/0080683 A1 5/2003 Inoue et al.
2003/0178938 A1 * 9/2003 Kao et al. ..... 313/582
2004/0160187 A1 * 8/2004 Yao ..... 313/609
2007/0001605 A1 * 1/2007 Kim et al. ..... 313/582

FOREIGN PATENT DOCUMENTS

JP 2001-325891 11/2001
WO WO 03/060864 7/2003

OTHER PUBLICATIONS

Patent Abstracts of Japan, vol. 2002, No. 03, Apr. 3, 2002, & JP 2001-325891 (See Ref. AD).
Search Report Dated Nov. 23, 2004.

* cited by examiner

*Primary Examiner*—Peter Macchiarolo
(74) *Attorney, Agent, or Firm*—Robert D. Shedd; Patricia Verlangieri

(57) ABSTRACT

Display panel comprising two plates, separated by a gas-filled space partitioned by separating elements forming an array of barrier ribs, and arrays of coplanar sustain electrodes and address electrodes; with each cell subdivided into a trigger zone at each of the intersections of an address electrode with a sustain electrode and into at least one coplanar discharge expansion zone that extends between the trigger zones, the array of barrier ribs is designed so that, in each cell, each coplanar expansion zone has a width that is less than the width of all the trigger zones.

By applying a method of driving the sustain discharges in the display panel by matrix triggering, the luminous efficiency is very substantially improved.

14 Claims, 3 Drawing Sheets

PLASMA DISPLAY-PANEL COMPRISING A REDUCED-SECTION DISCHARGE EXPANSION ZONE

FIELD OF THE INVENTION

The invention relates to a plasma display panel comprising (with reference to FIGS. 1A and 1B) a first plate 11 and a second plate 12 with a space between them filled with a discharge gas, said space being partitioned, in particular by an array of barrier ribs, into a plurality of discharge cells 17 arranged in rows and columns.

DESCRIPTION OF THE PRIOR ART

The first plate 11 comprises at least two arrays of coplanar electrodes Y, Y' called sustain electrodes, which are oriented along general directions that are parallel to each other and to the rows of cells and that are coated with a dielectric layer 13 and with a protective and secondary-electron-emitting layer 14 (shown dotted in the figure).

The second plate 12 comprises at least one array of electrodes X called address electrodes, which are oriented along general directions that are parallel to each other and to the columns of cells and that are coated with a dielectric layer 16.

The electrodes Y, Y', X of the various arrays are arranged in such a way that each discharge cell is crossed by an electrode from each array.

The array of insulating barrier ribs comprises intercell separating elements 15, each separating two adjacent columns of cells.

Finally, the sidewalls of the barrier ribs and the second plate are covered with a phosphor layer (not shown) capable of emitting visible light under the excitation from the discharges in the cells.

The invention also relates to an image display device comprising such a plasma display panel and means for driving and supplying the electrodes of this panel, these being designed:

- to generate addressing operations so as to selectively activate cells and to generate sustain operations so as to obtain plasma discharges only in the cells that have been activated beforehand; and
- so that, during sustain phases, the coplanar sustain discharges are triggered by matrix discharges.

For this purpose, the drive and supply means are designed:

- to apply between the address electrode X and one of the sustain electrodes Y and Y' that cross each cell 17, an address voltage signal suitable for depositing activating electric charges on the dielectric layer covering said sustain electrode; and
- to apply, between the sustain electrodes Y, Y' that cross each row of cells, a succession of sustain voltage signals suitable for generating plasma discharges only in those cells of this row that have been activated beforehand and to generate, just before or during each sustain signal, between the address electrodes X and one or other of the sustain electrodes Y or Y' that cross the cells of this row, a trigger voltage signal suitable for triggering said discharges.

The trigger signals may be induced automatically or applied intentionally using a suitable generator. These signals induce matrix discharges in the thickness of the gas space separating the plates, for the purpose of making it easier to initiate sustain discharges between the coplanar electrodes.

Document U.S. Pat. No. 6,184,848 discloses an image display device of this type, suitable for controlling the coplanar discharges by matrix triggering.

SUMMARY OF THE INVENTION

It is an object of the invention to improve the luminous efficiency of this type of display panel.

For this purpose, the subject of the invention is a plasma display panel comprising a first plate and a second plate with a space between them filled with a discharge gas, said space being partitioned, in particular by an array of barrier ribs, into a plurality of discharge cells arranged in rows and columns,

- said first plate comprising at least two arrays of coplanar electrodes called sustain electrodes, which are oriented along general directions that are parallel to each other and to said rows,
- said second plate comprising at least one array of electrodes called address electrodes, which are oriented along general directions that are parallel to each other and to said columns,
- said electrodes being placed so that, in each cell, an address electrode crosses an electrode of each sustain array,
- said array of barrier ribs comprising inter-column separating elements, each separating two adjacent columns of cells, characterized in that, with each cell subdivided into a trigger zone at each of the intersections of the address electrode with a sustain electrode, and into at least one coplanar discharge expansion zone that extends between the trigger zones, said array of barrier ribs is designed so that, in each cell, each coplanar expansion zone has, within an interval lying between the trigger zones that delimit it along the columns, a width which, when measured between two adjacent separating elements that delimit it along the rows, is less than the width of all the trigger zones measured between two adjacent separating elements that also delimit these zones along the rows.

All the widths are measured along the rows.

Since there at least two arrays of coplanar electrodes and since, in each cell, an address electrode crosses an electrode of each sustain array, in each cell there are necessarily several intersections between the address electrode and a sustain electrode, and therefore several trigger zones, more precisely at least two. Thus, each cell comprises at least two trigger zones, each lying at an intersection between the address electrode and a sustain electrode.

Each expansion zone forms a channel intended to contain the positive pseudo-column of the coplanar plasma discharge. According to the invention, this channel has at least one narrower portion for constricting the positive pseudo-column. This narrower portion corresponds to the interval lying between the trigger zones. The expansion zone may be narrow for the entire length of the channel, in which case the said interval corresponds to the distance between the trigger zones.

It should be pointed out that the plasma display panel described in document WO 03/060864 (not published at the priority date of the present document, but a priori benefiting from an earlier priority date) has, in each cell, one or more cavities. When these cavities are curved or elliptical, as in FIGS. 10C and 10D of said document, these cavities provide coplanar expansion zones whose width, measured along the rows, is not constant. However, nothing in that document suggests that there exist, in each cell, at least two trigger zones at the intersection between an address electrode carried by one plate and a coplanar electrode carried by the other plate, much less that there exists an interval between these trigger zones, still less that the width of the expansion zone measured along the rows in this interval is less than the width of the expansion zones also measured along the rows.

It should be pointed out that the plasma display panel disclosed in document US 2003/0080683 is provided with an array of address electrodes and with four (or even only three) arrays of coplanar electrodes. As in the invention, in each cell, an address electrode crosses an electrode of each coplanar array. As indicated at §30 of said document (and explained in greater detail below), it is one of the coplanar electrodes X' or Y' positioned at the center of each cell that serves to trigger each coplanar discharge, and not the address electrode, as in the invention. In the trigger zone of each cell, in this case in the center of said cell, the barrier rib separating the columns extends only up to mid-height so that the cells seem wider at this point, at least on that side of the plate bearing the coplanar electrodes (see FIG. 1 of the document). However:

- if only a single trigger zone were to exist in each cell, the coplanar expansion zone between the electrodes X and Y would not have, contrary to the invention, an interval between the trigger zones;
- if, as in the invention, two trigger zones were to exist in each cell (at the intersection between X' and A, and at the intersection between Y' and A), then, in the interval between these zones, the width of the expansion zone would not, at any point in this interval, be less than the width of one or other of the expansion zones, unlike in the invention. This is because in this interval, as in each trigger zone, the barrier rib that separates the columns extends only to mid-height so that the width is identical at all points.

Preferably, the array of barrier ribs is designed so that, in each cell, the width of each coplanar expansion zone measured along the direction of the rows between two adjacent separating elements that delimit it is at least 15% less than the width of all the trigger zones measured along the direction of the rows between two adjacent separating elements that delimit them.

Preferably, the first plate comprises only two arrays of coplanar sustain electrodes, unlike the panel disclosed in document US 2003/0080683. According to a variant, each sustain electrode serves the cells of two consecutive rows of cells, thus simplifying the manufacture of the display panel.

Preferably, said intercolumn separating elements extend continuously over approximately the entire height of said space between the plates, unlike the barrier ribs described in document US 2003/0080683.

Preferably, the second plate comprises only a single array of address electrodes, so that each cell is crossed only by a single address electrode, thus simplifying the manufacture of the display panel.

The voltage for igniting a sustain discharge between two coplanar sustain electrodes obviously depends on the electric charges stored beforehand on the dielectric layer covering these electrodes in the vicinity of the ignition zone. These charges may have been stored beforehand during a previous sustain discharge or during an address operation. Thus, before a sustain discharge in a cell, positive charges are generally stored on the sustain electrode that will serve as anode and negative charges on the sustain electrode that will serve as cathode. These stored charges create what is called a memory voltage, and the ignition voltage corresponds to the voltage of a sustain signal, applied between the electrodes, to which the memory voltage is added.

At the moment of ignition of a sustain discharge in a cell, the electron avalanche produced in the discharge gas between the electrodes crossing this cell creates a positive space charge that is concentrated around the cathode so as to form what is called a cathode sheath. The plasma zone, called the positive pseudo-column, which lies between the cathode sheath and the anode end of the discharge, contains positive and negative charges in identical proportions. This zone is therefore current conducting and the electric field therein is low. The electrons present in the positive pseudo-column zone have a relatively low energy, which favors excitation of the discharge gas and production of ultraviolet photons with a high energy efficiency.

During this discharge, most of the potential drop along the electric field lines between the electrodes crossing the cell corresponds to the cathode sheath zone. The impact of the ions, which are accelerated in the intense field of the cathode sheath and strike the protective and secondary-electron-emitting layer that coats the dielectric layer and the sustain electrodes, results in a substantial emission of secondary electrons near the cathode. Under the effect of this intense electron multiplication, the density of the conducting plasma between the electrodes then greatly increases, in both ion density and electron density, thereby causing the cathode sheath to contract near the cathode and causing the sheath to be positioned at the point where the ions from the plasma are deposited on that portion of the dielectric surface covering the coplanar electrode serving as cathode. On the anode(s) side, the electrons in the plasma, which are much more mobile than the ions, are deposited on that portion of the dielectric surface covering the coplanar electrode serving as anode, so as to neutralize, progressively from the front rearward, the layer of positive "memory" charges stored beforehand. When all of this stored positive charge has been neutralized, the potential between the anode and the cathode then starts to fall. The electric field in the cathode sheath then reaches a maximum, corresponding to the maximum contraction of the sheath, and the electric current between the electrodes is then also a maximum.

The luminous efficiency of plasma display panels is generally low, since most of the electrical energy for supplying the display panel and for sustaining the display is dissipated in accelerating the ions and in heating the walls owing to the ion sputtering effect. Document U.S. Pat. No. 6,184,848 describes a means of driving the sustain discharges that makes possible a first improvement in the luminous efficiency of the discharges. As illustrated in FIGS. 1A and 1B, the distance or "gap" separating the sustain electrodes Y, Y' is substantially increased so that the discharges between these two electrodes are only possible by means of a low-intensity trigger discharge. As illustrated in FIG. 2A, such a trigger discharge $D_M$ is obtained following a trigger signal automatically induced, or intentionally applied, between one of the sustain electrodes, Y', serving as cathode and the address electrode X serving as intermediate anode. As illustrated in FIG. 2B, since electrons move more rapidly than ions, they follow the lines of increasing potential as far as the second sustain electrode Y serving as anode and, as illustrated in FIG. 2C, establish a current between the two sustain electrodes, creating a long positive pseudo-column $D_E$ in which the excitation of the gas is highly efficient in terms of light emission, generally UV. Thus, the luminous efficiency of the plasma display panels is very substantially improved.

It has been found that the efficiency of the sustain discharges is affected by:

- the efficiency of the trigger discharges in the triggering or matrix discharge zone; and
- the efficiency of the positive pseudo-columns in the expansion zones between the sustain electrodes.

Owing to the short distance between the sustain electrode and the address electrode within each matrix discharge zone or trigger zone, the matrix discharge may lack effectiveness if the current density therein is too high, since in this case the electric field therein is high. To limit the matrix discharge current density and thus limit the development of a cathode sheath within these discharges, it is therefore preferable to work with a low capacitance between the electrodes intersecting in the trigger zone so that the anode spread is very rapid and so that the increase in current density takes place only when the discharge has been converted into a coplanar discharge and is fully extended across the coplanar discharge expansion zone between the sustain electrodes (FIG. 2C), rather than when the discharge is still in the matrix state (FIG. 2A) and the positive pseudo-column has yet to be formed (which would cause the equivalent of a short circuit). However, if the capacitance between the electrodes in the trigger zones is reduced, the operating voltages of the display panel increase, which would be a problem. To reduce these voltages, it is necessary to increase the avalanche gain. This can be achieved, according to a first essential feature of the invention, by moving the barrier ribs in the trigger zones further apart so as to widen these zones or to increase the area of their cross section.

The luminous efficiency of the positive pseudo-column of the coplanar discharge depends directly on the density of the current flowing through it. If the current density decreases, the efficiency increases. To reduce the current density, it is proposed, according to a second essential feature of the invention, to reduce the available cross section for the positive pseudo-column of the coplanar discharge in the expansion zone by suitable constriction means, for example:

- by bringing the barrier ribs closer together in the expansion zone between the trigger zones;
- by subdividing the zone lying between the trigger zones into at least two mutually parallel narrower expansion zones by means of intracell separating elements.

Electron diffusion is thus increased and the current density decreased during the coplanar discharge expansion phase.

A further improvement in the luminous efficiency of plasma display panels is thus obtained by widening the cells at the point where the discharges are ignited, that is to say in the trigger zones, and by constricting the cells or subdividing them in the expansion zones. Thus, according to the invention, for each cell the cross section of one or other of the trigger zones has an area greater than the cross sections of each expansion zone. Thus, the aim of the invention is to optimize the profile of the barrier ribs of the display panel so as to encourage ignition with low anode capacitance by means of a large cathode area, while still maintaining a very effective positive pseudo-column.

To summarize, the plasma display panel according to the invention comprises two plates separated by a gas-filled space partitioned by separating elements forming an array of barrier ribs, and arrays of coplanar sustain electrodes and address electrodes; with each cell subdivided into a trigger zone at each of the intersections of an address electrode with a sustain electrode and into at least one coplanar discharge expansion zone that extends between the trigger zones, the array of barrier ribs is designed so that, in each cell, each coplanar expansion zone has a width that is preferably at least 15% less than the width of all the trigger zones.

According to a first embodiment, each cell comprises only a single expansion zone between two adjacent trigger zones.

In this case, the separating elements that delimit trigger zones or expansion zones also delimit the cells. These are intercell separating elements that form part of the array of barrier ribs, each element separating two adjacent columns of cells. According to the invention, each cell therefore has a narrowing only in each expansion zone and a widening in each trigger zone. These narrowings and widenings may especially be obtained by adapting the array of barrier ribs—the intercolumn separating elements are widened at the position of the narrowings and narrowed at the position of the widenings.

Adapting the array of barrier ribs then results overall in an increase in the total area of the tops of the ribs, thereby advantageously increasing the area of the contrast-enhancing black matrix generally applied to the tops of the ribs, and thus increasing the image display contrast in ambient light.

According to a variant of this embodiment, the cells of any one column of the display panel are shifted in the general direction of the columns relative to the cells of an adjacent column, so as to obtain better cell imbrication. This advantageously increases the density or the area of the cells of the panel.

According to a second embodiment, each cell comprises a plurality of expansion zones between two adjacent trigger zones.

These various expansion zones of any one cell are therefore placed in parallel between any two same expansion zones. This subdivision of the cells in the width direction, only between the trigger zones and not in the trigger zones themselves, is another advantageous means of constricting the expansion zones. The reduction in the number of expansion zones provides an appreciable improvement in the luminous efficiency of the display panel.

Preferably, according to this second embodiment of the invention, each cell is subdivided by at least one intracell separating element that extends along the direction of the columns in said interval lying between the trigger zones and that delimits two adjacent expansion zones of this cell.

These intracell separating elements also form part of the array of barrier ribs. Their dimensions are designed so as to obtain the plurality of zones operating in parallel. These intracell separating elements are generally not bearing elements, that is to say their height is generally less than that of the intercell separating elements, and also less than the distance between the plates.

This subdivision of the cells by intracell separating elements that do not extend over the entire length of the cells but only over an interval lying between the coplanar electrodes, means that, according to the invention, narrower expansion zones are obtained without having to change the width of the trigger zones.

Unlike the intracell separating elements described in document U.S. Pat. No. 6,376,995, especially in FIG. 21 of that document, the intracell barrier rib elements according to the invention are interrupted in the matrix discharge trigger zones, that is to say generally at the intersections between the address electrodes and the sustain electrodes, so as to leave a larger space for the triggering matrix discharges.

Each cell is preferably crossed only by a single address electrode. Preferably, the intracell separating element is then positioned opposite this address electrode, unlike the display panel shown in FIG. 21 of U.S. Pat. No. 6,376,995.

Preferably, the coplanar electrodes are coated with a dielectric layer and with a protective and secondary-electron-emitting layer. The dielectric layer thus provides the memory effect that allows the display panel to be driven by a succession of address and sustain operations, while the protective and secondary-electron-emitting layer helps to lower the operating voltages of the display panel.

Preferably, in each cell, the distance that separates the electrodes of the various coplanar arrays is greater than the distance that separates the plates. Such a panel structure is particularly advantageous when suitable means for driving and supplying the electrodes are used so that each coplanar discharge is triggered by a matrix discharge.

The distance separating two sustain electrodes corresponds to the coplanar gap, while the distance between the plates corresponds to the thickness of the gas space between the plates. The invention therefore preferably applies to what are called "wide-gap" display panels, these being particularly suitable for being driven by matrix triggering. In practice, a gap of around 500 μm is commonly used.

The subject of the invention is also an image display device comprising a plasma display panel according to the invention, characterized in that it comprises means for driving and supplying the electrodes of this display panel that are capable of applying signals to these electrodes suitable for generating, in each cell, coplanar discharges between the various coplanar electrodes that cross the cell and so that these discharges are each triggered by a matrix discharge between the address electrode that crosses said cell and one of said coplanar electrodes.

To drive the panel, the frames of the images to be displayed are generally subdivided, in a manner known per se, into subframes capable of generating, by their succession, the gray levels needed for the display.

To drive the panel, the display of a subframe generally comprises, in a manner known per se, an address step and a sustain step. The address step, which generally comprises a single voltage pulse, has the purpose of generating the surface charges needed to trigger the first coplanar sustain discharge of the next step, only and selectively in those cells of the panel that have to be activated during the subframe in question. The sustain step that follows comprises one voltage pulse for each coplanar discharge to be generated in the subframe. During this step, and unlike in the preceding step, the same voltage pulses are applied between the coplanar electrodes of a number of cells, whether or not they had been activated beforehand. During this step, coplanar discharges will take place only in cells that were activated beforehand. According to the invention, each of the coplanar discharges of this sustain step is triggered by a matrix discharge between an address electrode on one plate and a coplanar electrode on the other plate.

Each coplanar discharge, that is to say a discharge between two electrodes on the same plate, is therefore triggered by a matrix discharge, that is to say a discharge between two electrodes on two different plates. This trigger discharge is therefore different from an address discharge which similarly takes place between two electrodes on two different plates, but only in preparation for a sustain phase.

It should be pointed out that the display device disclosed in document US 2003/0080683 describes a plasma display panel provided with one array of address electrodes and four arrays of coplanar electrodes. As indicated in §30 of that document, the electrodes X', Y' of the first two arrays of coplanar electrodes are close together (i.e. with a small gap between them) so as to make it easier to create coplanar discharges. These small-gap coplanar discharges serve to trigger the "main" wide-gap coplanar discharges between electrodes X, Y of the other two coplanar arrays that are much further apart.

Thus, unlike in the invention, in document US 2003/0080683 it is not a matrix discharge between an address electrode and coplanar electrode that triggers each main coplanar discharge, but a small-gap coplanar discharge between two small-gap coplanar electrodes. Thus, unlike in the invention, in document US 2003/0080683 the triggering electrode, X' or Y', does not cross over an electrode of each sustain array in each cell.

BRIEF DESCRIPTION OF THE DRAWINGS

The invention will be more clearly understood on reading the description that follows, given by way of nonlimiting example and with reference to the appended figures in which:

FIG. 3: the sustain electrodes are not straight; they serve the cells directly; and they are not provided with branches;

FIG. 4: the sustain electrodes are straight and are provided with branches for serving the cells;

FIG. 5: each coplanar electrode serves only a single row of cells; and

FIG. 6: each coplanar electrode serves two adjacent rows of cells.

To simplify the description and to bring out the differences and advantages afforded by the invention over the prior art, identical references will be used for elements that fulfill the same functions.

DESCRIPTION OF THE PREFERRED EMBODIMENTS

Figure 1A:
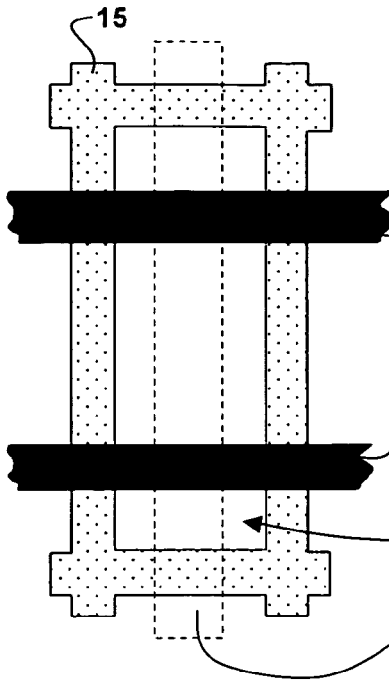
FIGS. 1A and 1B, already described, show a top view and a sectional view, respectively, of one cell of a plasma display panel according to the prior art.
Figure 1B:
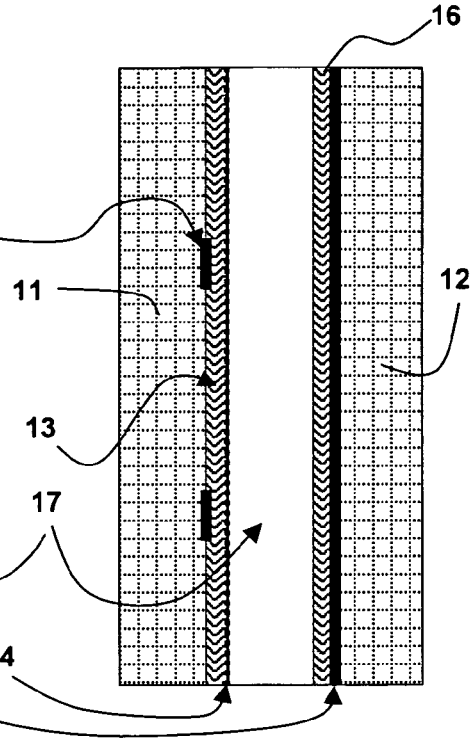
Figure 2A:
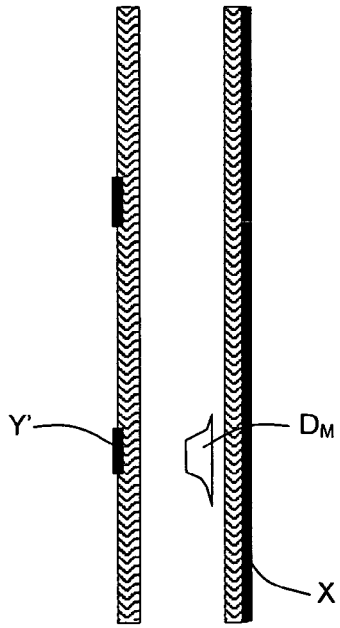
FIGS. 2A, 2B and 2C, already described, show the various steps in the development of a sustain discharge triggered by a matrix discharge in the cell of FIG. 1, shown schematically in cross section with just the electrodes and the dielectric layers that cover them.
Figure 2B:
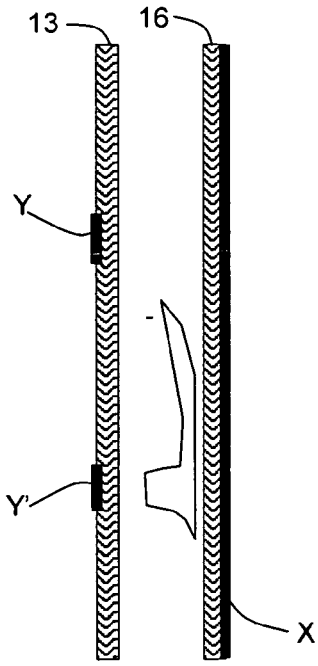
Figure 2C:
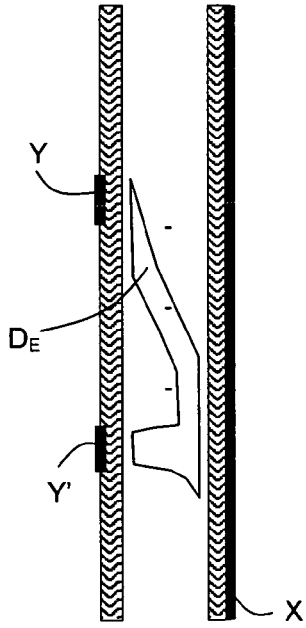
Figure 3:
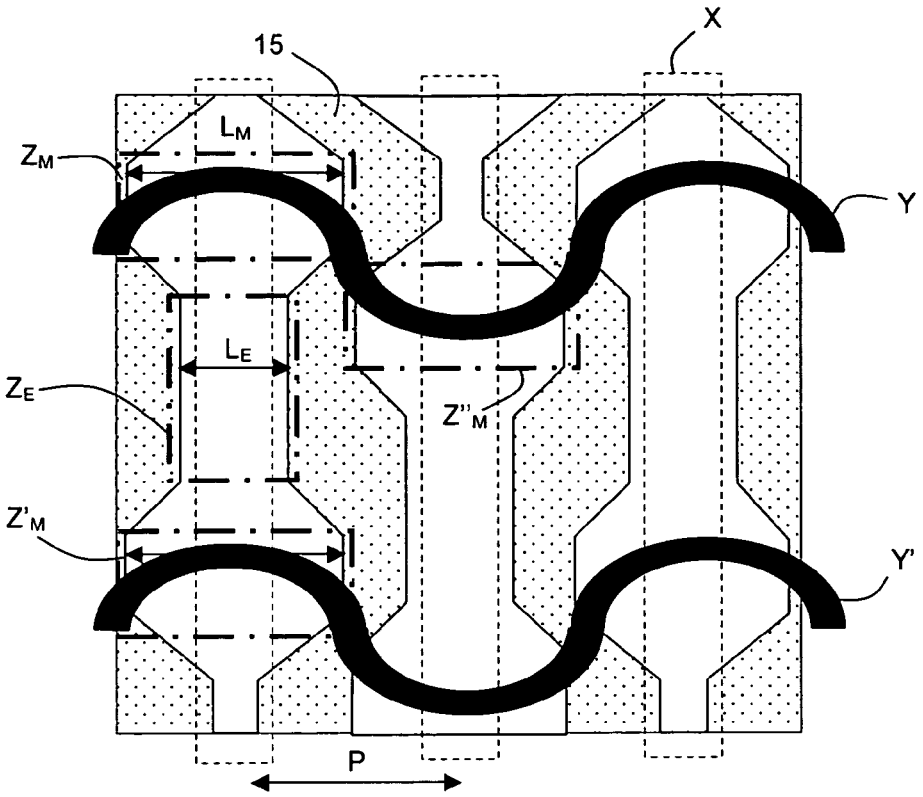
FIGS. 3 and 4 illustrate a first family of embodiments of the invention in which each cell comprises only a single expansion zone, and they show, in top view, a set of three cells of a display panel according to the invention in which the adjacent cells of any one row are offset with respect to one another and in which, for each cell, the width of trigger zones is greater than the width of the single expansion zone.

According to a first family of embodiments, the plasma display panel according to the invention is mainly distinguished from the display panel described above with reference to FIGS. 1A and 1B in that the column separating elements 15 vary in width, as illustrated in FIG. 3. Thus, the cell width $L_M$ measured in the matrix discharge trigger zones $Z_M$, $Z'_M$, that is to say at the intersections between the address electrode and one of the sustain electrodes Y, Y', is greater than or equal to the spacing p of the electrodes X of the address array, whereas the cell width $L_E$ measured in the expansion zone $Z_E$, that is to say between the sustain electrodes Y, Y', is less than the same spacing p.

Thus, when driving the coplanar discharges by matrix triggering, the avalanche gain in the matrix discharge trigger zone is increased and the diffusion and efficiency of the discharge in the expansion zone of the positive pseudo-column are increased.

The cells of the panel are arranged in a staggered fashion with respect to one another, so as to best distribute the wider portions of cells, that is to say the matrix discharge zones. Thus, as shown in FIG. 3, each matrix discharge zone of a cell belonging to a nonadjacent column of the panel lies either between the expansion zones of adjacent column cells (the case of $Z''_M$ in the figure) or between the zones that separate two cells of different rows in these adjacent columns (the case of $Z_M$, $Z'_M$). Thus, the cells of any one column of the display panel are offset in the general direction of the columns relative to the cells of an adjacent column.

This family of embodiments further increases the possible area of the black matrix placed for example on the tops of the barrier ribs and intended to enhance the image display contrast. This allows a low-transmission neutral filter to be used and further improves the final luminous efficiency of the plasma display panel.

The staggered arrangement of the cells results, as shown in FIG. 3, in sustain electrodes that have a sinuous, non-straight profile.

Figure 4:
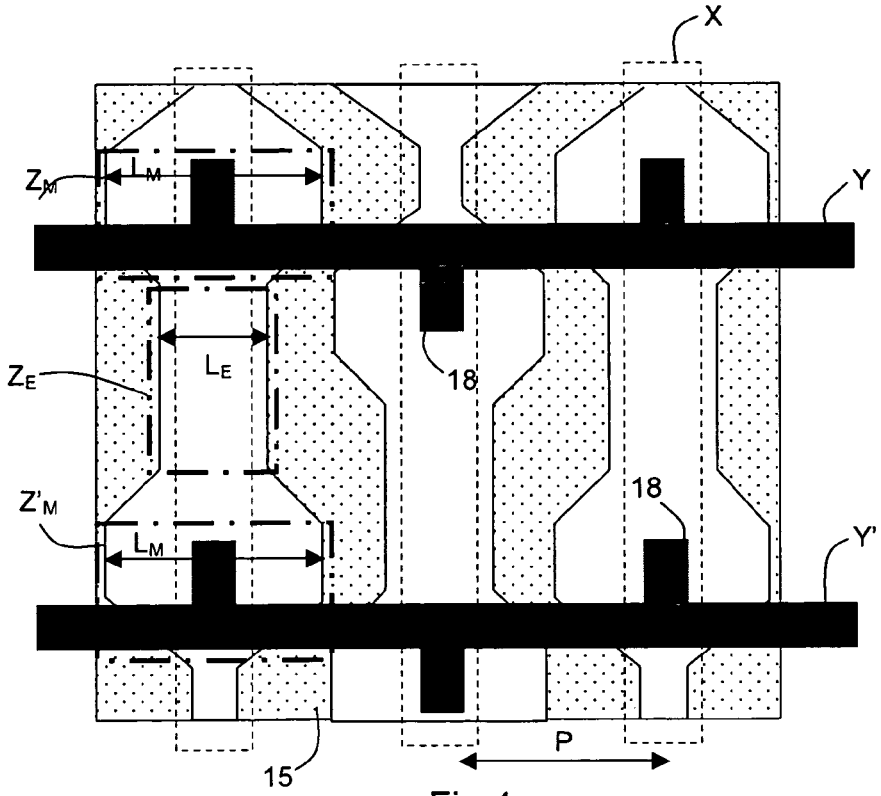

FIG. 4 illustrates a variant of the display panel shown in FIG. 3, in which the cells are also arranged in a staggered fashion, but in which the sustain electrodes are however straight. The sustain electrodes Y, Y' are provided here with branches 18 which extend toward the centers of the matrix discharge zones $Z_M$, $Z'_M$. These branches may be made of a transparent conductive material such as ITO.

Figure 5:
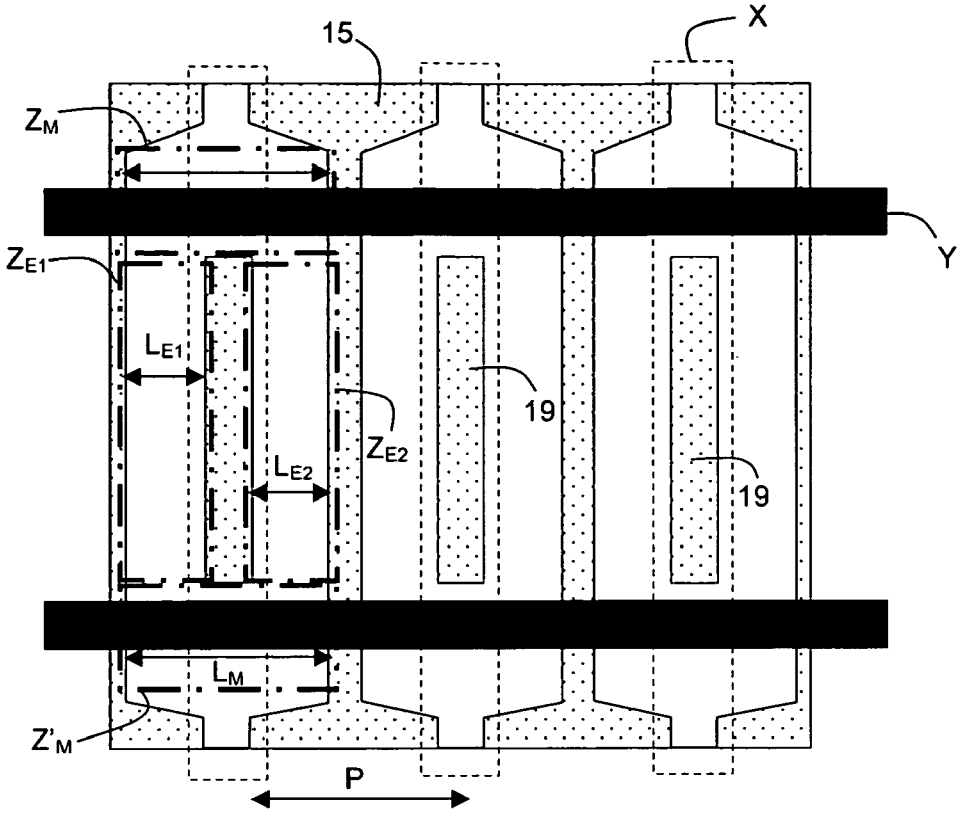
FIGS. 5 and 6 illustrate a second family of embodiments of the invention in which each cell comprises two expansion zones in parallel, and they show, in a top view, a set of three cells of a display panel according to the invention, in which each cell is divided by an intracell separating element that extends only between the sustain electrodes.

According to a second family of embodiments of the invention, the plasma display panel according to the invention is mainly distinguished from the display panel described above with reference to FIGS. 1A and 1B in that, as shown in FIG. 5, each cell is provided with an intracell separating element 19 that extends only between the sustain electrodes Y, Y', so as to obtain two expansion zones $Z_{E1}$, $Z_{E2}$ in parallel. The luminous efficiency of the display panel is thus even further improved. The dimensions and the material of this separating element are designed in a manner known per se, in order to obtain this splitting of the positive pseudo-column into two, so as to bring the plasma very close to wall elements of the cell, namely the separating elements 15, 19. In practice, the intracell separating elements 19 are integrated into the array of barrier ribs and produced at the same time, and in the same material, as the intercell separating elements 15. In practice, the width of the intracell separating elements 19 is equal to or greater than 40 μm.

By placing these intracell separating elements only between the sustain electrodes outside the matrix discharge zones, what is obtained is a reduction or constriction in the cross section of the cells in the expansion zones, even though the distance between the intercell separating elements 15 is constant over practically the entire length of the cells. Thus, the cell width $L_M$ in the matrix discharge zones $Z_M$, $Z'_M$ is greater than the width $L_{E1}$, $L_{E2}$ of each expansion zone $Z_{E1}$, $Z_{E2}$.

This second family of embodiments of the invention is also advantageous over the first family because it allows the area available for the phosphors in each cell, especially on the side walls of the intercell or intracell separating elements, to be increased. It should be noted that the phosphor layer has not been shown in the figures. This increase in available area for the phosphors helps to improve the luminous efficiency.

Figure 6:
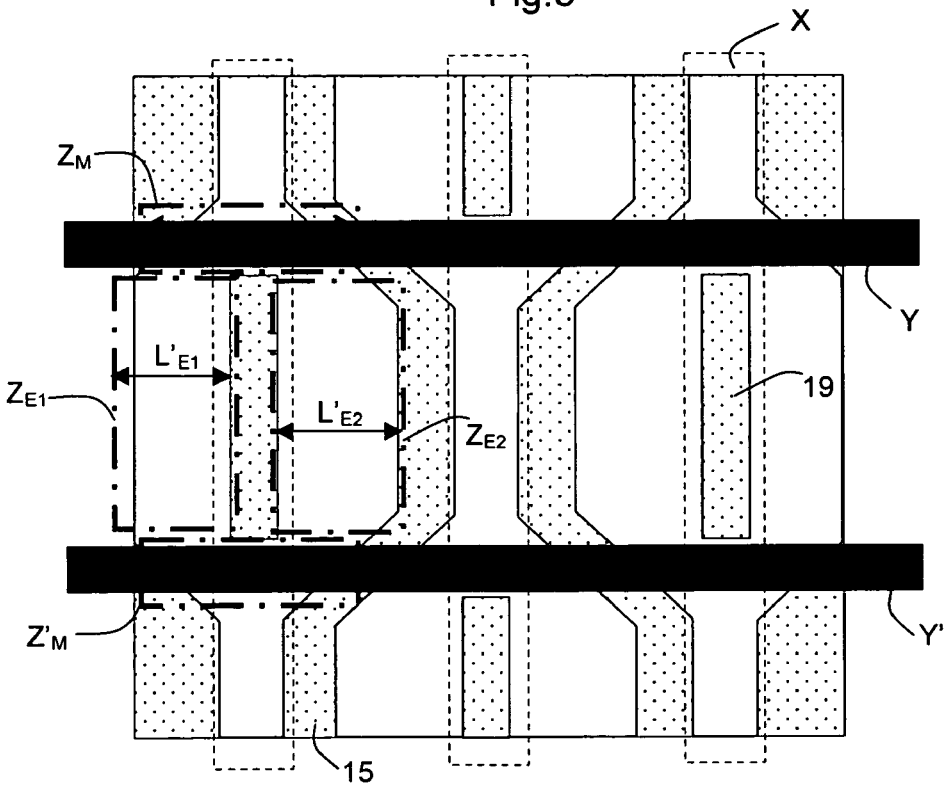

Owing to manufacturing constraints, the spacing p between columns of cells may interfere with the deposition of phosphors between the two expansion zones $Z_{E1}$, $Z_{E2}$. It is therefore preferable to use the staggered arrangement of cells as shown in FIG. 6. In this version of the display panel shown in FIG. 5, each sustain electrode simultaneously serves two consecutive rows of cells.

If there is only one address electrode X per cell, it is advantageous to place this electrode beneath the intracell separating elements 19, as shown in FIGS. 5 and 6, so as to increase the dielectric thickness on these electrodes and thus greatly decrease the anode capacitance, thereby increasing the electron spread rate and the formation of the positive column.

In both families of embodiments that have just been described, in zones that separate two cells of different rows, the distance between the intercell separating elements that delimit these cells is reduced, but is not zero. This distance is less than the width of the expansion zones $L_E$, $L_{E1}$, $L_{E2}$ and is not zero, in order advantageously to provide a recess that makes it easier to deposit phosphors in the columns, thereby reducing the risk of depositing phosphors on the tops of the barrier ribs.

The plasma display panels that have just been described may be produced by methods known per se, but which will not be described here.

The present invention may apply to other types of plasma display panel without departing from the scope of the claims appended hereto.

These plasma display panels are advantageously integrated into displays that include supply and drive means, especially for carrying out sustain operations in which each sustain discharge is triggered by a matrix discharge. Such supply and drive means are known to those skilled in the art and have been briefly described above but are described in greater detail for example in the abovementioned document U.S. Pat. No. 6,184,848.

The invention claimed is:

1. A plasma display panel comprising a first plate and a second plate with a space between them filled with a discharge gas, said space being partitioned, by separating elements forming an array of barrier ribs, into a plurality of discharge cells arranged in rows and columns, said first plate comprising at least two arrays of coplanar electrodes called sustain electrodes, which are oriented along general directions that are parallel to each other and to said rows, said second plate comprising at least one array of electrodes called address electrodes, which are oriented along general directions that are parallel to each other and to said columns, said electrodes being placed so that, in each cell, an address electrode crosses an electrode of each sustain array, wherein each cell is subdivided into at least two trigger zones each located at an intersection of the address electrode with a sustain electrode and into a single coplanar discharge expansion zone that extends along the direction of the columns between the trigger zones, and wherein said array of barrier ribs comprises intercell separating elements, each separating two adjacent columns of cells, and is designed so that, in each cell belonging to a given column and a given row, the width of said coplanar discharge expansion zone, measured along said row between two adjacent intercell separating elements is less than the width of the trigger zones of said cell also measured along said row between the same two adjacent intercell separating elements.

2. The plasma display panel as claimed in claim 1, wherein the first plate comprises only two arrays of coplanar sustain electrodes.

3. The plasma display panel as claimed in claim 1, wherein said intercell separating elements extend continuously over approximately the entire height of said space between the plates.

4. The plasma display panel as claimed in claim 1 wherein, in each cell, the distance that separates the electrodes of the various coplanar arrays is greater than the distance that separates the plates.

5. The plasma display panel as claimed in claim 1 wherein said array of barrier ribs is designed so that, in each cell, said width of the coplanar discharge expansion zone is at least 15% less than said width of the trigger zones.

6. The plasma display panel as claimed in claim 1 wherein said coplanar electrodes are coated with a dielectric layer and with a protective and secondary-electron-emitting layer.

7. An image display device comprising a plasma display panel as claimed in claim 1, wherein it comprises means for driving and supplying the electrodes of this display panel that are capable of applying signals to these electrodes suitable for generating, in each cell, coplanar discharges between the various coplanar electrodes that cross the cell and so that these discharges are each triggered by a matrix discharge between the address electrode that crosses said cell and one of said coplanar electrodes.

8. A plasma display panel comprising a first plate and a second plate with a space between them filled with a discharge gas, said space being partitioned by separating elements forming an array of barrier ribs into a plurality of discharge cells arranged in rows and columns, said first plate comprising at least two arrays of coplanar electrodes called sustain electrodes, which are oriented along general directions that are parallel to each other and to said rows, said second plate comprising at least one array of electrodes called address electrodes, which are oriented along general directions that are parallel to each other and to said columns, said electrodes being placed so that, in each cell, an address electrode crosses an electrode of each sustain array, wherein each cell is subdivided into at least two trigger zones each located at an intersection of the address electrode with a sustain electrode, and is also subdivided into a plurality of adjacent coplanar discharge expansion zones between two of the trigger zones by at least one intracell separating element that extends along the direction of the columns in an interval lying between two of the trigger zones, each intracell separating element delimiting two adjacent coplanar discharge expansion zones of this cell, and wherein said array of barrier ribs comprises intercell separating elements, each separating two adjacent columns of cells and limiting notably the trigger zones, and comprises also said intracell separating elements, and wherein said array of barrier ribs is designed so that, in each cell belonging to a given column and a given row, the width of each coplanar expansion zone, measured along said row between two adjacent intercell or intracell separating elements limiting this coplanar discharge expansion zone, is less than the width of the trigger zones of said cell, also measured along said row between two adjacent intercell separating elements.

9. The plasma display panel as claimed in claim 8, wherein the first plate comprises only two arrays of coplanar sustain electrodes.

10. The plasma display panel as claimed in claim 8, wherein said intercell separating elements extend continuously over approximately the entire height of said space between the plates.

11. The plasma display panel as claimed in claim 8, wherein, in each cell, the distance that separates the electrodes of the various coplanar arrays is greater than the distance that separates the plates.

12. The plasma display panel as claimed in claim 8, wherein said array of barrier ribs is designed so that, in each cell, said width of each coplanar expansion zone is at least 15% less than said width of the trigger zones.

13. The plasma display panel as claimed in claim 8, wherein said coplanar electrodes are coated with a dielectric layer and with a protective and secondary-electron-emitting layer

14. An image display device comprising a plasma display panel as claimed in claim 8, wherein said display device comprises means for driving and supplying the electrodes of the display panel that are capable of applying signals to said electrodes suitable for generating, in each cell, coplanar discharges between the various coplanar electrodes that cross the cell and so that said discharges are each triggered by a matrix discharge between the address electrode that crosses said cell and one of said coplanar electrodes.

* * * * *